US010493780B1

(12) United States Patent
Yoshida

(10) Patent No.: US 10,493,780 B1
(45) Date of Patent: Dec. 3, 2019

(54) PAPER EJECTION APPARATUS INCLUDING TRAY STORED IN A HOUSING TO BE PULLABLE OUT

(71) Applicant: PFU LIMITED, Kahoku-shi, Ishikawa (JP)

(72) Inventor: Hiroki Yoshida, Kahoku (JP)

(73) Assignee: PFU LIMITED, Kahoku-Shi, Ishikawa (JP)

( * ) Notice: Subject to any disclaimer, the term of this patent is extended or adjusted under 35 U.S.C. 154(b) by 0 days.

(21) Appl. No.: 16/116,651

(22) Filed: Aug. 29, 2018

(30) Foreign Application Priority Data

May 11, 2018 (JP) ..... 2018-092117

(51) Int. Cl.

| | |
|---|---|
| ***B65H 31/00*** | (2006.01) |
| ***B41J 13/10*** | (2006.01) |
| ***B41J 29/13*** | (2006.01) |
| ***B65H 31/02*** | (2006.01) |

(52) U.S. Cl.
CPC ..... *B41J 13/106* (2013.01); *B41J 29/13* (2013.01); *B65H 31/02* (2013.01); *B65H 2405/115* (2013.01); *B65H 2405/11164* (2013.01); *B65H 2405/111646* (2013.01); *B65H 2405/32* (2013.01); *B65H 2405/324* (2013.01); *G03G 2215/00421* (2013.01)

(58) Field of Classification Search
CPC ..... B65H 2405/11646; B65H 2405/11151; B65H 2405/1164; B65H 2405/115; B65H 2405/32; B65H 2405/321
See application file for complete search history.

(56) References Cited

U.S. PATENT DOCUMENTS

| | | | | |
|---|---|---|---|---|
| 7,290,952 | B2 * | 11/2007 | Kagami | B41J 13/106 271/144 |
| 8,172,222 | B2 * | 5/2012 | Yoda | B65H 31/02 271/162 |
| 9,376,284 | B2 * | 6/2016 | Komuro | B65H 31/02 |
| 2004/0017460 | A1 | 1/2004 | Kagami et al. | |
| 2014/0319760 | A1 * | 10/2014 | Komuro | B65H 31/20 271/223 |

FOREIGN PATENT DOCUMENTS

| | | |
|---|---|---|
| JP | 2004-35248 | 2/2004 |

* cited by examiner

*Primary Examiner* — Howard J Sanders
(74) *Attorney, Agent, or Firm* — Lewis Roca Rothgerber Christie LLP

(57) ABSTRACT

The paper ejection apparatus includes a housing including an ejection slot for ejecting a paper and a storage space provided below the ejection slot, a tray, formed in an arcuate shape to extend downwards and stored in the storage space to be pullable out from the storage space, for stacking the paper ejected from the ejection slot when the tray is pulled out from the storage space, and a cover swingably provided on the housing between the ejection slot and an opening of the storage space. A swinging end of the cover moves downwards by working with an operation for pulling the tray out from the storage space.

5 Claims, 12 Drawing Sheets

PAPER EJECTION APPARATUS INCLUDING TRAY STORED IN A HOUSING TO BE PULLABLE OUT

CROSS-REFERENCE TO RELATED APPLICATIONS

This application is based upon and claims the benefit of priority of prior Japanese Patent Application No. 2018-092117, filed on May 11, 2018, the entire contents of which are incorporated herein by reference.

TECHNICAL FIELD

Embodiments discussed in the present specification relate to a paper ejection apparatus.

BACKGROUND

In recent years, a paper ejection apparatus such as an image reading apparatus or an image copying apparatus is desirably compact in size when the device is not in use. Under the circumstances, a paper ejection apparatus having a storage tray is used in which, for example, a tray for stacking ejected paper is provided in a storage space of a housing that is pullable and is stored in the storage space when the device is not in use.

A recording device is disclosed which includes an ejection tray that stacks and holds recording sheets ejected from an opening in the device, a tray storage part that stores the ejection tray that is pullable and stored, and a front cover pivotably provided on the device. In the recording device, the front cover is provided below the ejection tray to support the ejection tray pulled out from the tray storage part (see Japanese Unexamined Patent Publication (Kokai) No. 2004-35248).

SUMMARY

Generally, in a paper ejection apparatus, a tray is provided such that its downstream side is set higher than its upstream side in the paper ejection direction to appropriately stack ejected paper on the tray. With this arrangement, in a paper ejection apparatus including a tray provided so as to be stored in a storage space of a housing, the ejected paper may return to the upstream side in the paper ejection direction and enter the gap between the storage space and the tray. Therefore, such a paper ejection apparatus prevents the ejected paper from entering the gap between the storage space and the tray.

It is an object to provide to a paper ejection apparatus that includes a tray that can be stored in a storage space of a housing so as to prevent ejected paper from entering the gap between the storage space and the tray.

According to an aspect of the apparatus, there is provided an paper ejection. The paper ejection apparatus includes a housing including an ejection slot for ejecting a paper and a storage space provided below the ejection slot, a tray, formed in a downward arcuate shape and stored in the storage space to be pullable out from the storage space, for stacking the paper ejected from the ejection slot when the tray is pulled out from the storage space, and a cover swingably provided on the housing between the ejection slot and an opening of the storage space. A swinging end of the cover moves downwards by working with an operation for pulling the tray out from the storage space.

The object and advantages of the invention will be realized and attained by means of the elements and combinations particularly pointed out in the claims. It is to be understood that both the foregoing general description and the following detailed description are exemplary and explanatory, and are not restrictive of the invention, as claimed.

DESCRIPTION OF EMBODIMENTS

Hereinafter, a paper ejection apparatus according to an embodiment, will be described with reference to the drawings. However, it should be noted that the technical scope of the invention is not limited to these embodiments, and extends to the inventions described in the claims and their equivalents.

Figure 1A:
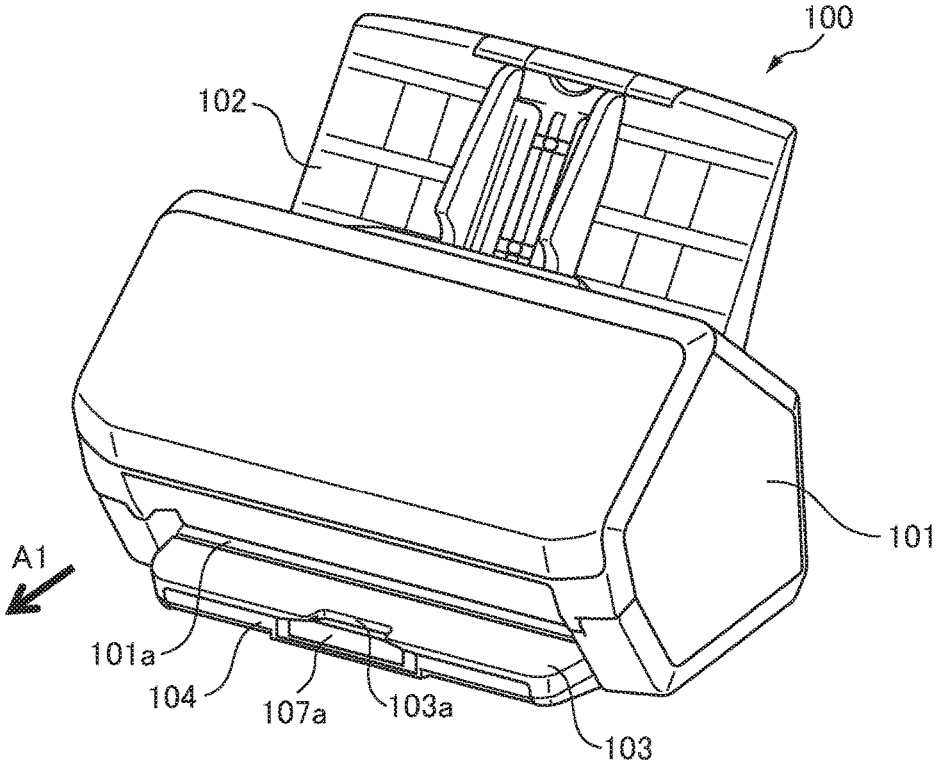
FIG. 1A is a perspective view illustrating a paper ejection apparatus 100.
Figure 1B:
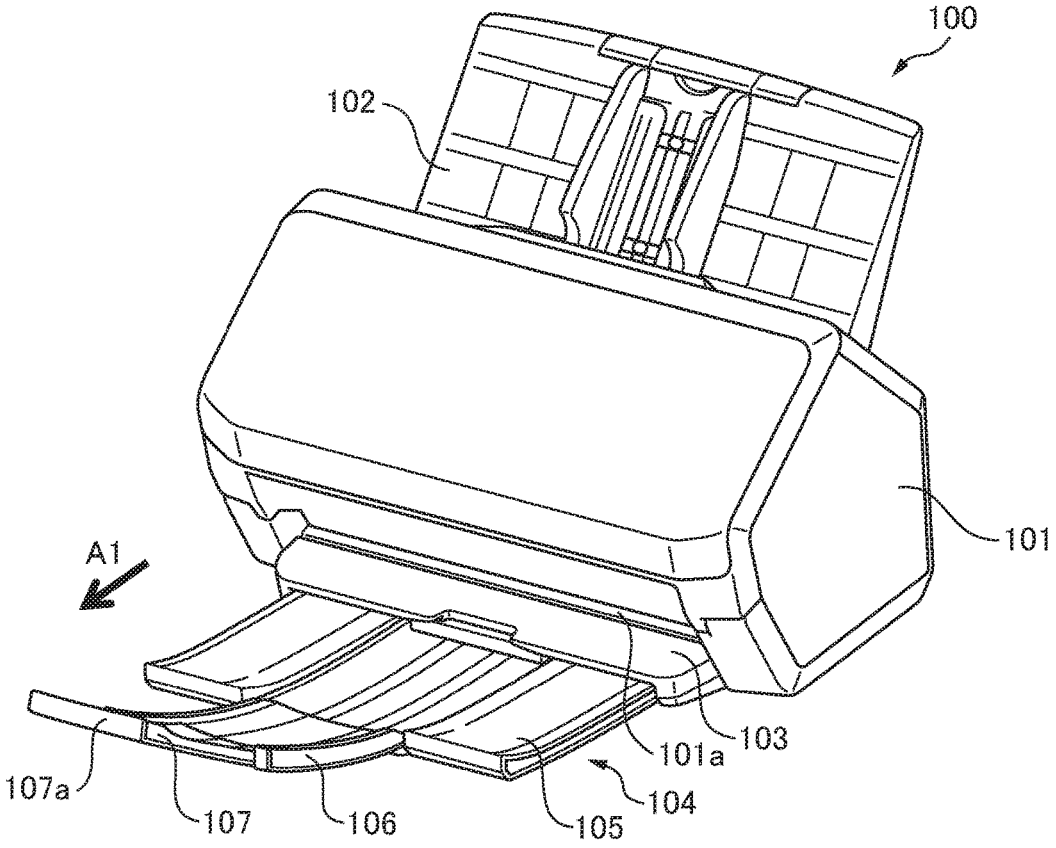
FIG. 1B is a perspective view illustrating the paper ejection apparatus 100.

FIGS. 1A and 1B are perspective views illustrating a paper ejection apparatus 100 designed as an image scanner. FIG. 1A illustrates the paper ejection apparatus 100 not in use, and FIG. 1B illustrates the paper ejection apparatus 100 in use.

The paper ejection apparatus 100 includes a housing 101, a paper support 102, a cover 103 and a tray 104 etc.

The housing 101 is made of a resin material etc., and covers parts placed in the paper ejection apparatus 100. The housing 101 includes a conveyance roller and an image sensing device (not shown) and generates an image by reading paper sheets (document) mounted on the paper support 102 while conveying them. The housing 101 further includes an ejection slot 101*a* which ejects the conveyed paper, and ejects the conveyed paper from the ejection slot 101*a* onto the tray 104.

The paper support 102 is made of a resin material etc., and engages with the housing 101. The paper support 102 supports the paper mounted on it and continuously feeds each mounted paper to the housing 101.

The cover 103 is made of a resin material etc., and provided on the housing 101 between the ejection slot 101*a* and the tray 104. As illustrated in FIG. 1A, the cover 103 covers the downstream end of the tray 104, stored in the housing 101, in a paper ejection direction A1 when the paper ejection apparatus 100 is not in use. As illustrated in FIG. 1B, the cover 103 covers the upstream end of the tray 104 in the paper ejection direction A1 when the paper ejection apparatus 100 is in use.

The tray 104 is made of a resin material etc., and provided on the housing 101 at a position below the cover 103. As illustrated in FIG. 1A, the tray 104 is stored in the housing 101 when the paper ejection apparatus 100 is not in use. As illustrated in FIG. 1B, the tray 104 is pulled out in the paper ejection direction A1 and stacks the paper ejected from the ejection slot 101*a* when the tray 104 is pulled out from the housing 101, when the paper ejection apparatus 100 is in use. The tray 104 includes a tray body 105, a first slide tray 106 provided to be pullable out from the tray body 105, and a second slide tray 107 provided to be pullable out from the first slide tray 106. Since a handle 107*a* is provided at the downstream end of the second slide tray 107, the user can pull the first slide tray 106 and the second slide tray 107 out from the tray body 105 by drawing the handle 107*a*.

As illustrated in FIG. 1A, since the cover 103 includes a notch 103*a* formed in it and opposed to the handle 107*a* with the tray 104 stored, the user can pull out the tray 104 by gripping the handle 107*a* with the tray 104 stored.

Figure 2A:
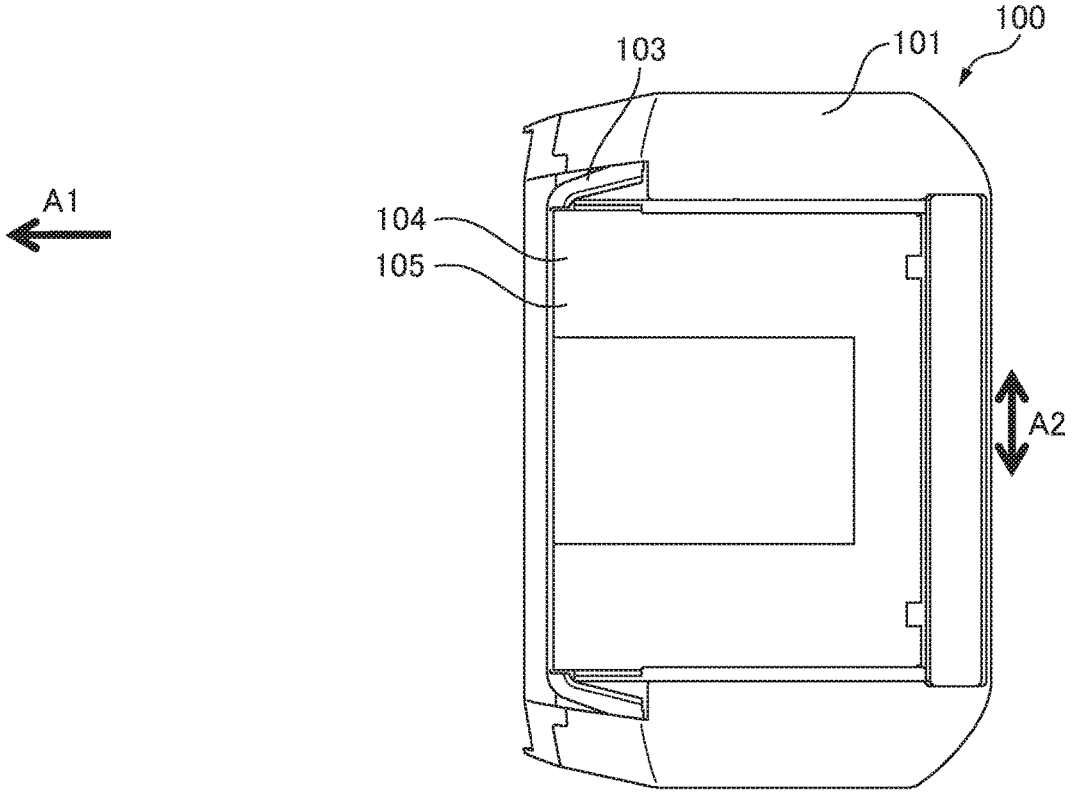
FIG. 2A is a bottom view illustrating the paper ejection apparatus 100.
Figure 2B:
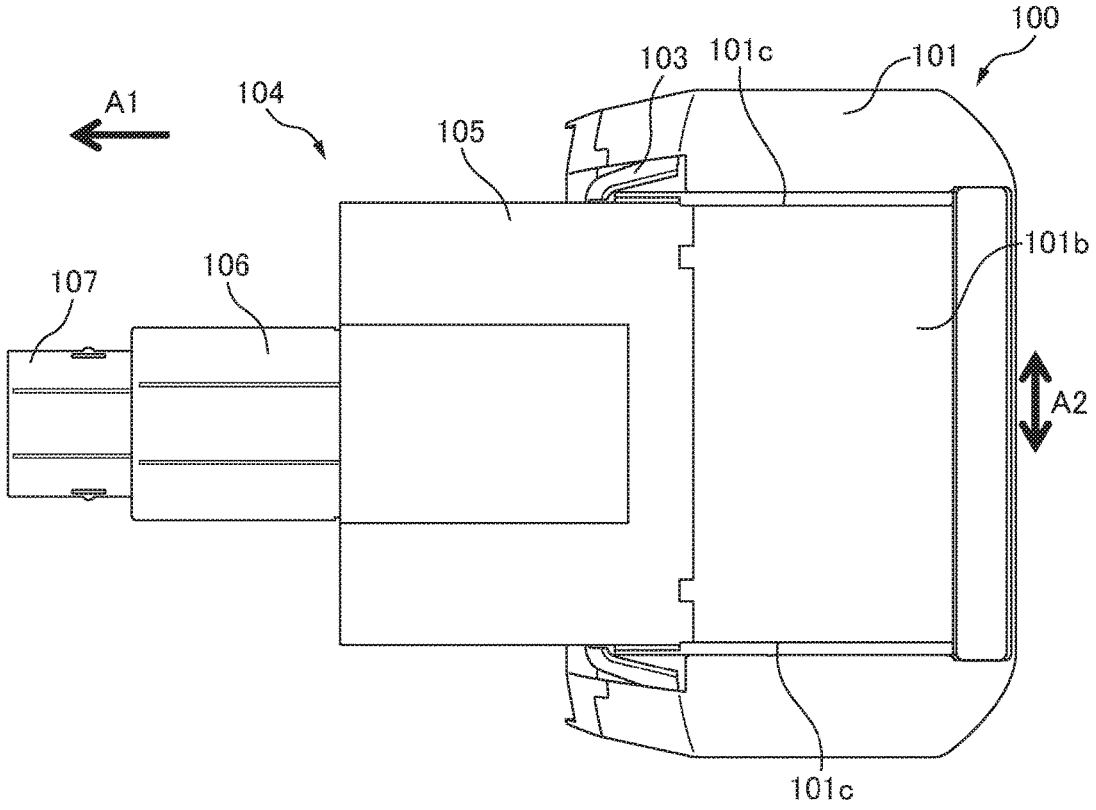
FIG. 2B is a bottom view illustrating the paper ejection apparatus 100.

FIG. 2A is a bottom view illustrating the paper ejection apparatus 100 not in use, and FIG. 2B is a bottom view illustrating the paper ejection apparatus 100 in use.

The housing 101 includes a storage space 101*b* which stores the tray 104, as illustrated in FIGS. 2A and 2B. The storage space 101*b* is provided below the ejection slot 101*a*. The storage space 101*b* includes storage rails 101*c* provided at two ends in a direction A2 perpendicular to the paper ejection direction A1 and extending in the paper ejection direction A1. The tray 104 is stored in the storage space 101*b* along the storage rails 101*c*, as illustrated in FIG. 2A, and pulled out from the storage space 101*b* along the storage rails 101*c*, as illustrated in FIG. 2B. In this embodiment, the storage space 101*b* is exposed on the lower surface of the housing 101, but it may be covered by the lower surface of the housing 101.

Figure 3A:
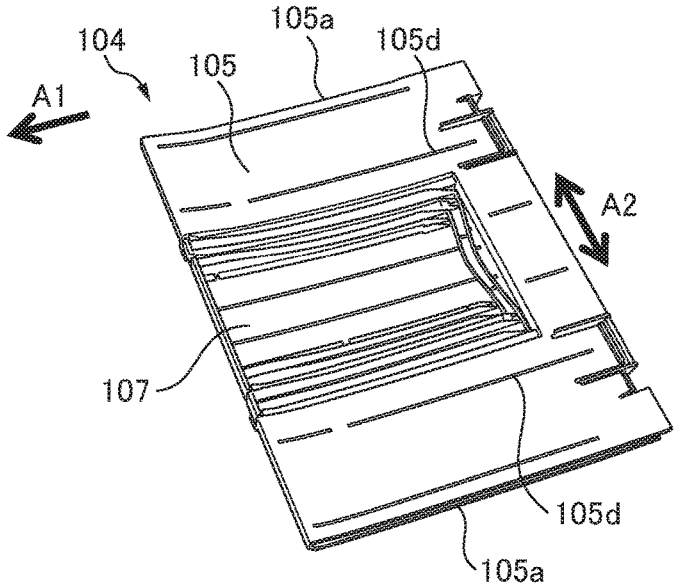
FIG. 3A is a perspective view illustrating a tray 104.
Figure 3B:
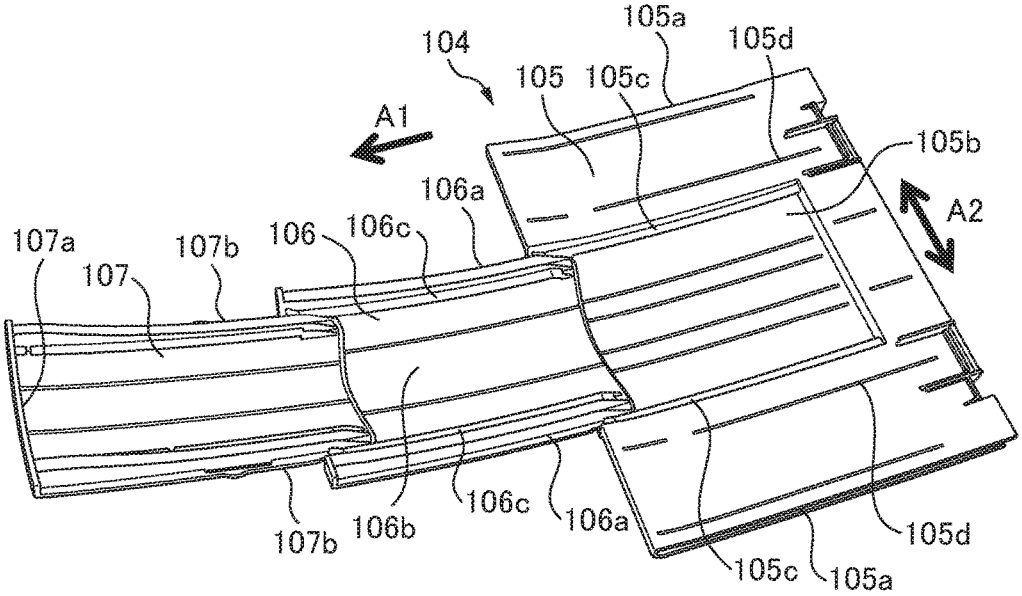
FIG. 3B is a perspective view illustrating the tray 104.
Figure 4A:
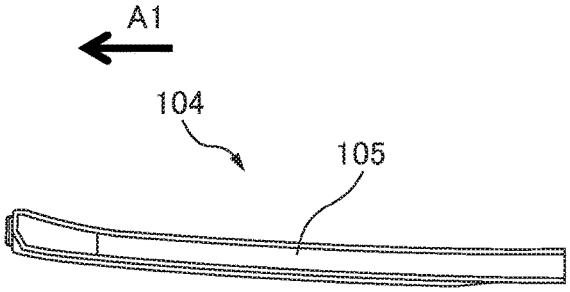
FIG. 4A is a side view illustrating the tray 104.
Figure 4B:
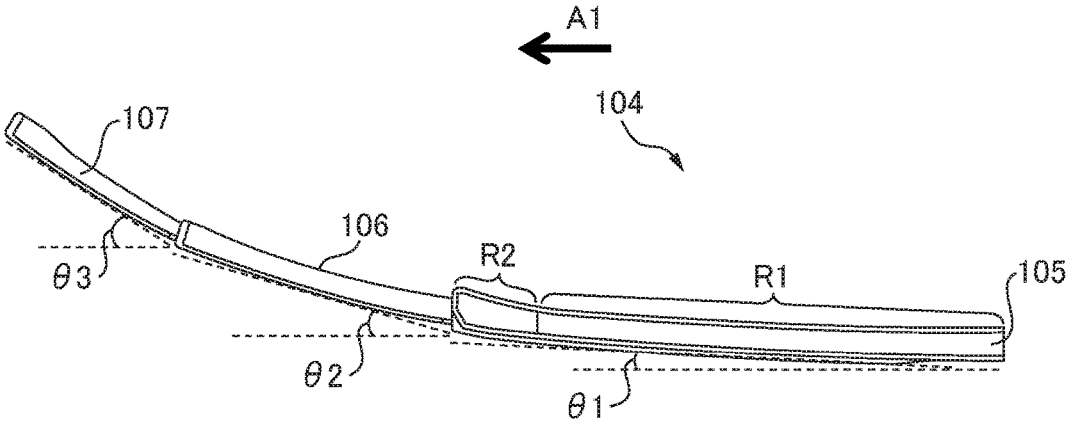
FIG. 4B is a side view illustrating the tray 104.

FIGS. 3A and 3B are perspective views illustrating the tray 104 as removed from the paper ejection apparatus 100, and FIGS. 4A and 4B are side views illustrating the tray 104 as removed from the paper ejection apparatus 100. FIGS. 3A and 4A illustrate how the first slide tray 106 and the second slide tray 107 have been stored in the tray body 105, and FIGS. 3B and 4B illustrate how the first slide tray 106 and the second slide tray 107 have been pulled out from the tray body 105.

As illustrated in FIGS. 3A to 4B, each of the tray body 105, the first slide tray 106, and the second slide tray 107 is formed in a downward arcuate shape (to project to a lower face side of the slide tray 107, in other words, opposite side of a paper stacking face of the slide tray 107), i.e., to be located higher in areas more to the downstream side in the paper ejection direction A1.

As illustrated in FIG. 4B, the radius of curvature (of the upper surface) in a main region R1 on the upstream side of the tray body 105 in the paper ejection direction A1 is set to 1,200 to 1,400 mm and preferably to 1,300 mm. The radius of curvature (of the upper surface) in a downstream distal region R2 of the tray body 105 in the paper ejection direction A1 is set to 100 to 300 mm and preferably to 200 mm. The radius of curvature (of the upper surface) of the first slide tray 106 is set to 900 to 1,100 mm and preferably to 1,000 mm. The radius of curvature (of the upper surface) of the second slide tray 107 is set to 900 to 1,100 mm and preferably to 1,000 mm. In this manner, the tray 104 is formed such that the curvature at the downstream end of the tray 104 is larger than that at the upstream end of the tray 104 in the paper ejection direction A1 when the first and second slide trays 106 and 107 are either in use or not in use. The curvature is the reciprocal of the radius of curvature. The tray 104 is further formed such that the curvature takes gradually ascending values from the upstream side to the downstream side of the tray 104 in the paper ejection direction A1 when the first and second slide trays 106 and 107 are not in use.

The angle θ1 that a straight line connecting the two ends of the tray body 105 in the paper ejection direction A1 makes with the installation surface of the paper ejection apparatus 100 is substantially 8° (6° to 10°). The angle θ2 that a straight line connecting the two ends of the first slide tray 106 in the paper ejection direction A1 makes with the installation surface of the paper ejection apparatus 100 is substantially 20° (18° to 22°). The angle θ3 that a straight line connecting the two ends of the second slide tray 107 in the paper ejection direction A1 makes with the installation surface of the paper ejection apparatus 100 is substantially 32° (30° to 34°). In this manner, the ejected paper is appropriately stacked on the tray 104, without transporting them past the tray 104, by forming the tray 104 to be located higher in areas more to the downstream side in the paper ejection direction A1 (the stacking performance is improved).

The tray body 105 includes tray body guides 105*a* provided at the two ends in the direction A2 perpendicular to the paper ejection direction A1 and extending in the paper ejection direction A1. The tray 104 is pulled out from the storage space 101*b* or stored in the storage space 101*b* upon sliding of the tray body guides 105*a* along the storage rails 101*c* provided in the storage space 101*b*.

The tray body 105 further includes a tray body recess 105*b* formed in its upper surface (paper stacking surface), which stores the first slide tray 106. The tray body recess 105*b* includes tray body rails 105*c* provided at the two ends in the direction A2 perpendicular to the paper ejection direction A1 and extending in the paper ejection direction A1. The first slide tray 106 includes first slide tray guides 106*a* provided at the two ends in the direction A2 perpendicular to the paper ejection direction A1 and extending in the paper ejection direction A1. The first slide tray 106 is pulled out from the tray body recess 105*b* or stored in the tray body recess 105*b* upon sliding of the first slide tray guides 106*a* along the tray body rails 105*c*.

Similarly, the first slide tray 106 includes a first slide tray recess 106*b* formed in its upper surface (paper stacking surface), which stores the second slide tray 107. The first slide tray recess 106*b* includes first slide tray rails 106*c* provided at the two ends in the direction A2 perpendicular to the paper ejection direction A1 and extending in the paper ejection direction A1. The second slide tray 107 includes second slide tray guides 107*b* provided at the two ends in the direction A2 perpendicular to the paper ejection direction A1 and extending in the paper ejection direction A1. The second slide tray 107 is pulled out from the first slide tray recess 106*b* or stored in the first slide tray recess 106*b* upon sliding of the second slide tray guides 107*b* along the first slide tray rails 106*c*.

The tray body 105 further includes ribs 105*d* which extend in the paper ejection direction A1 and abut against the cover 103.

Figure 5A:
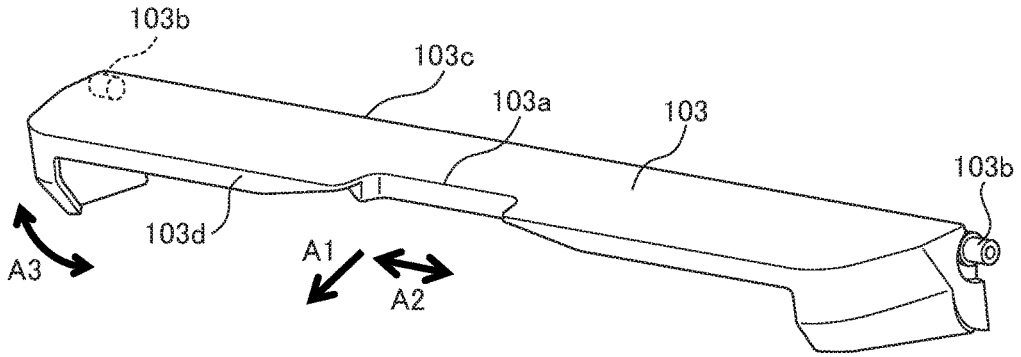
FIG. 5A is a perspective view illustrating a cover 103.
Figure 5B:
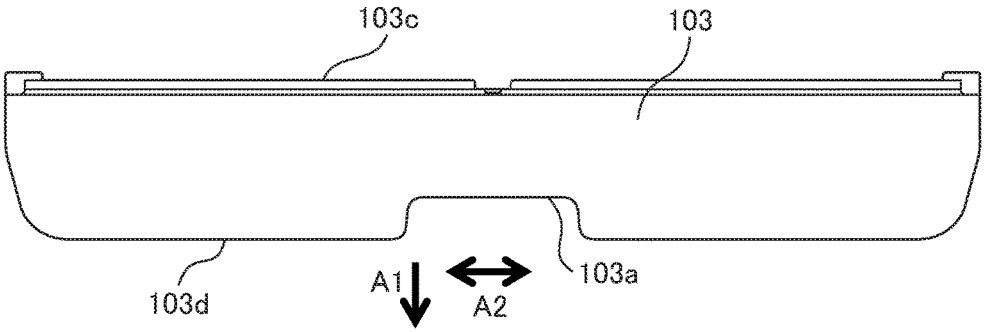
FIG. 5B is a top view illustrating the cover 103.
Figure 5C:
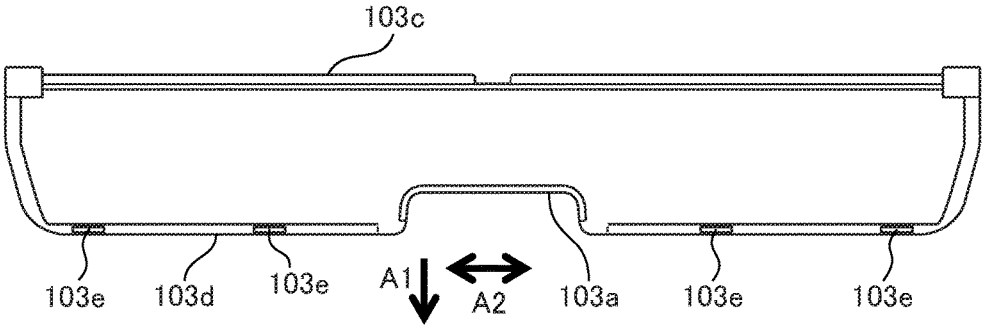
FIG. 5C is a bottom view illustrating the cover 103.

FIGS. 5A, 5B, and 5C are a perspective view, a top view, and a bottom view, respectively, illustrating the cover 103 as removed from the paper ejection apparatus 100.

As illustrated in FIGS. 5A to 5C, the cover 103 is formed in a plate shape with the paper ejection direction A1 as its widthwise direction and the direction A2 perpendicular to the paper ejection direction A1 as its longitudinal direction. The cover 103 includes shaft members 103*b* such as bosses provided at the upstream end in the paper ejection direction A1 and the two ends in the direction A2 perpendicular to the paper ejection direction A1. The cover 103 is supported to be swingable using the shaft members 103*b* as its swinging axes, i.e., about the shaft members 103*b* with respect to the housing 101 in the directions indicated by an arrow A3. The upstream end of the cover 103 in the paper ejection direction A1 will sometimes be referred to as a swinging shaft 103*c* hereinafter, and the downstream end of the cover 103 in the paper ejection direction A1 will sometimes be referred to as a swinging end 103*d* hereinafter.

The cover 103 includes protrusions 103*e* provided on the lower surface of the swinging end 103*d* to extend in the direction A2 perpendicular to the paper ejection direction A1. The protrusions 103*e* are opposed to the ribs 105*d* of the tray 104 and abut against the ribs 105*d* when the tray 104 is pulled out from the storage space 101*b*. In other words, the protrusions 103*e* slide along the ribs 105*d* by working with an operation for pulling the tray 104 out from the storage space 101*b* or an operation for storing the tray 104 in the storage space 101*b*. Instead of allowing the entire surface of the tray 104 and the entire surface of the cover 103 to abut against each other, allowing only the ribs 105*d* and the protrusions 103*e* to abut against each other keeps the area of contact between the tray 104 and the cover 103 small, resulting in less friction when the tray 104 is pulled out from the storage space 101*b*. Hence, the paper ejection apparatus 100 can smoothly pull out or store the tray 104.

Figure 6:
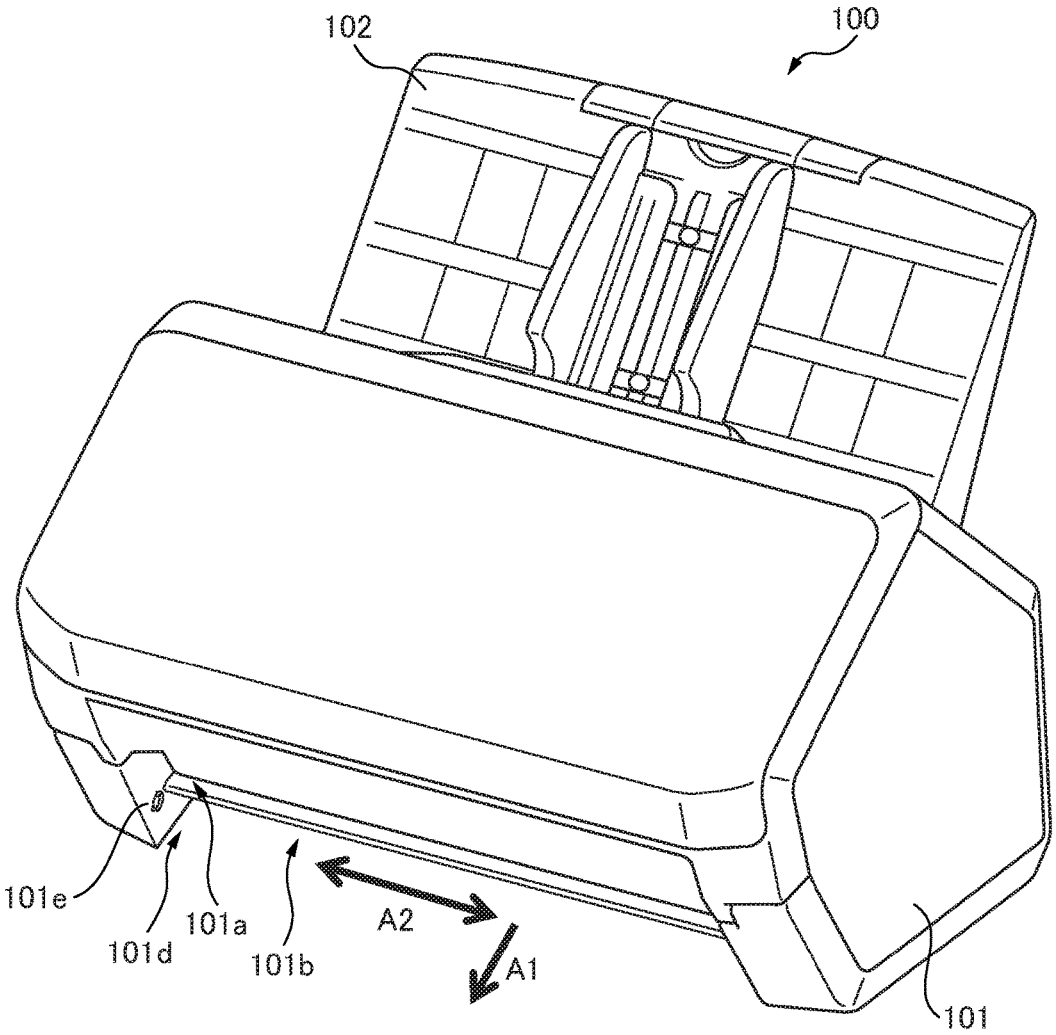
FIG. 6 is a perspective view illustrating a housing 101 with the cover 103 etc., removed from it.

FIG. 6 is a perspective view illustrating the housing 101 with the cover 103 and the tray 104 removed from it.

As illustrated in FIG. 6, the housing 101 includes bearings 101*e* formed in it between the ejection slot 101*a* and an opening 101*d* in the storage space 101*b* and implemented as, e.g., holes at the two ends in the direction A2 perpendicular to the paper ejection direction A1. The cover 103 is swingably provided around the opening 101*d* of the storage space 101*b*, especially between the ejection slot 101*a* and the opening 101*d*, by engaging the shaft members 103*b* of the cover 103 with the bearings 101*e*.

Figure 7A:
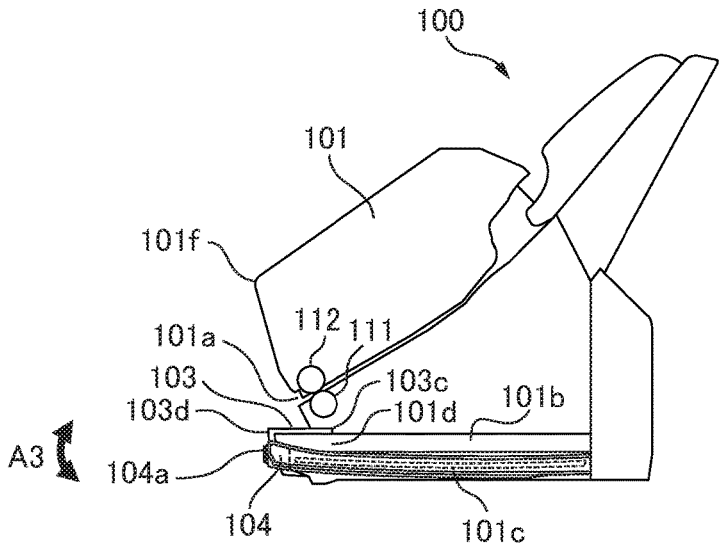
FIG. 7A is a schematic view for explaining the operations of the cover 103 and the tray 104.
Figure 7B:
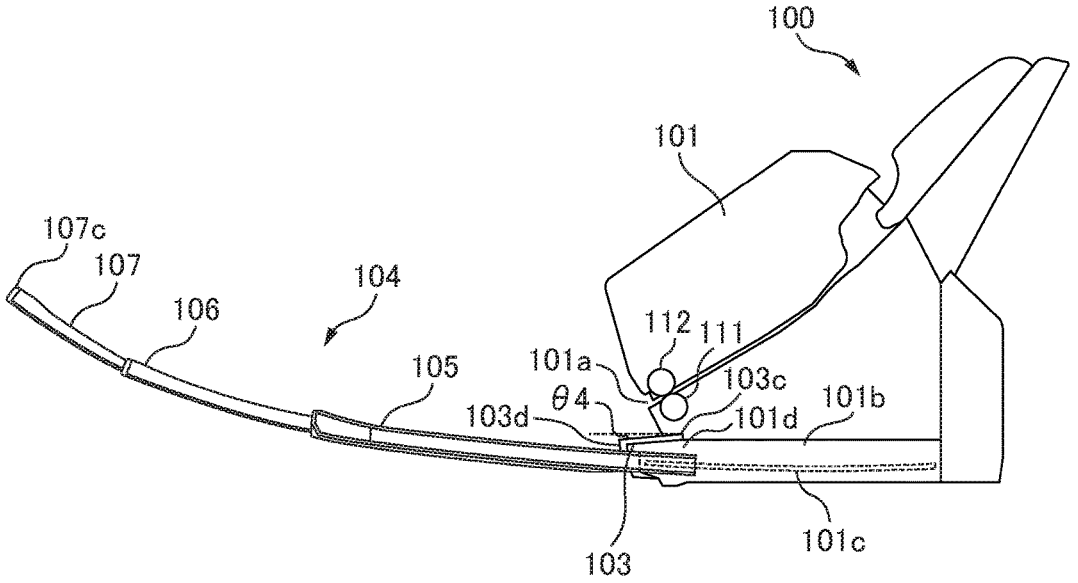
FIG. 7B is a schematic view for explaining the operations of the cover 103 and the tray 104.

FIGS. 7A and 7B are schematic views for explaining the operations of the cover 103 and the tray 104. FIG. 7A illustrates the paper ejection apparatus 100 not in use, and FIG. 7B illustrates the paper ejection apparatus 100 in use.

As illustrated in FIGS. 7A and 7B, an ejection roller 111 and a driven roller 112 are provided in the conveyance path of the paper ejection apparatus 100. The ejection roller 111 is located upstream of the ejection slot 101*a* in the paper ejection direction A1, especially in the vicinity of the ejection slot 101*a*, and the driven roller 112 is located opposite to the ejection roller 111 across the conveyance path. The ejection roller 111 and the driven roller 112 eject the conveyed paper onto the tray 104.

The cover 103 is swingably provided by working with an operation for storing the tray 104 in the storage space 101*b* and an operation for pulling the tray 104 out from the storage space 101*b*. As illustrated in FIG. 7A, when the first and second slide trays 106 and 107 are stored in the tray body 105 and the tray 104 is stored in the storage space 101*b*, a downstream end 104*a* of the tray 104 in the paper ejection direction A1 faces the swinging end 103*d* of the cover 103. With this arrangement, the opening 101*d* of the storage space 101*b* is covered by the cover 103 and the end 104*a* of the tray 104 with the tray 104 stored in the storage space 101*b*. The tray 104 is formed to be located higher in areas more to the downstream side in the paper ejection direction A1, as described above. Therefore, the swinging end 103*d* of the cover 103 is opposed to the end 104*a* of the tray 104 and located highest (above) with the tray 104 stored in the storage space 101*b*.

In this state, when the tray 104 is pulled out, the swinging end 103*d* of the cover 103 moves downwards by working with an operation for pulling the tray 104 out from the storage space 101*b*, as illustrated in FIG. 7B. Since the cover 103 moves with its swinging end 103*d* abutting against the tray 104, the gap between the storage space 101*b* and the tray 104 (the opening 101*d* between the upper surface of the storage space 101*b* and the upper surface of the tray 104) is always covered by the cover 103, regardless of movement of the tray 104. The angle that the cover 103 makes with the installation surface of the paper ejection apparatus 100 with the tray 104 stored in the storage space 101*b* of the housing 101 is substantially 0° (−2° to 2°). The angle θ4 that the cover 103 makes with the installation surface of the paper ejection apparatus 100 with the tray 104 pulled out from the housing 101 is substantially 5° (3° to 7°).

When the tray 104 is pushed into the storage space 101*b* in the state illustrated in FIG. 7B, the swinging end 103*d* of the cover 103 moves upwards to the position illustrated in FIG. 7A by working with an operation for pushing the tray 104 into the storage space 101*b*.

As illustrated in FIGS. 7A and 7B, since the angle that the storage rails 101*c* make with the installation surface of the paper ejection apparatus 100 is substantially 0° (−2° to 2°), the tray 104 is pulled out substantially horizontally with respect to the installation surface of the paper ejection apparatus 100. The tray 104 is formed in an arcuate shape with its downstream end 104*a* in the paper ejection direction A1 located highest, as described above. Therefore, the tray 104 is pulled out substantially horizontally, but nonetheless a downstream end 107*c* of the second slide tray 107 in the paper ejection direction A1 is located sufficiently high so that the paper ejection apparatus 100 can appropriately stack the ejected paper on the tray 104.

As illustrated in FIG. 7A, the tray 104 is provided such that its downstream end 104*a* in the paper ejection direction A1 projects from the opening 101*d* of the storage space 101*b*, when the tray 104 is stored in the storage space 101*b*. The paper ejection apparatus 100 can keep the height of the storage space 101*b* lower and, in turn, can keep the height of the entire paper ejection apparatus 100 lower with the end 104*a* highest in the tray 104 projecting from the opening 101*d*.

As illustrated in FIG. 7A, the tray 104 is provided such that its downstream end 104*a* in the paper ejection direction A1 is located upstream of a downstream end 101*f* of the housing 101 in the paper ejection direction A1, when the tray 104 is stored in the storage space 101*b*. With this arrangement, the paper ejection apparatus 100 can keep the depth smaller, without making the tray 104 project from the housing 101 when the device 100 is not in use, so that the user can easily store the paper ejection apparatus 100 in a shelf etc.

The technical meaning of always covering the gap between the storage space 101*b* and the tray 104 by the cover 103, regardless of movement of the tray 104, by moving the swinging end 103*d* of the cover 103 downwards in response to an operation for pulling out the tray 104 will be explained below.

Figure 8A:
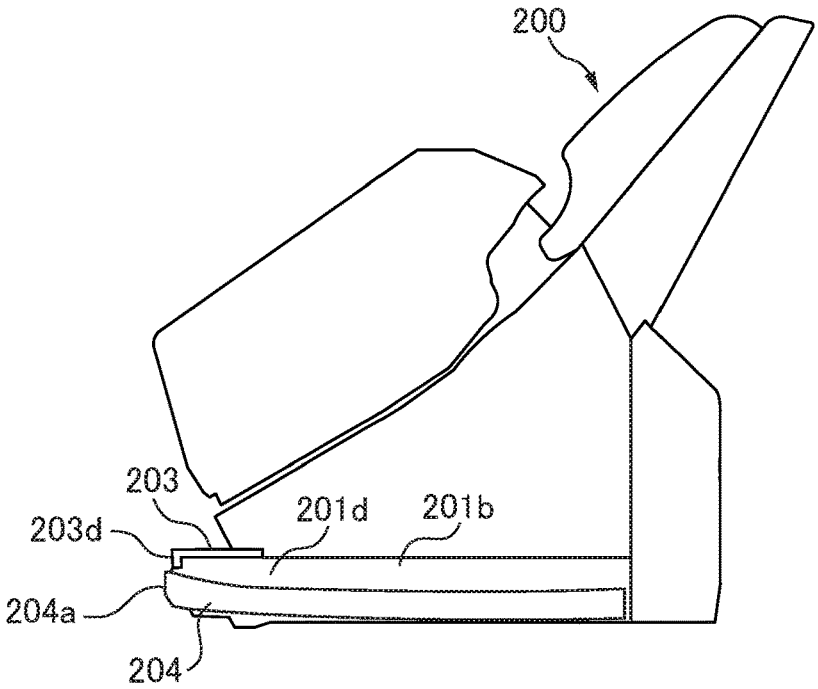
FIG. 8A is a schematic view for explaining a paper ejection apparatus including a cover fixed in position.
Figure 8B:
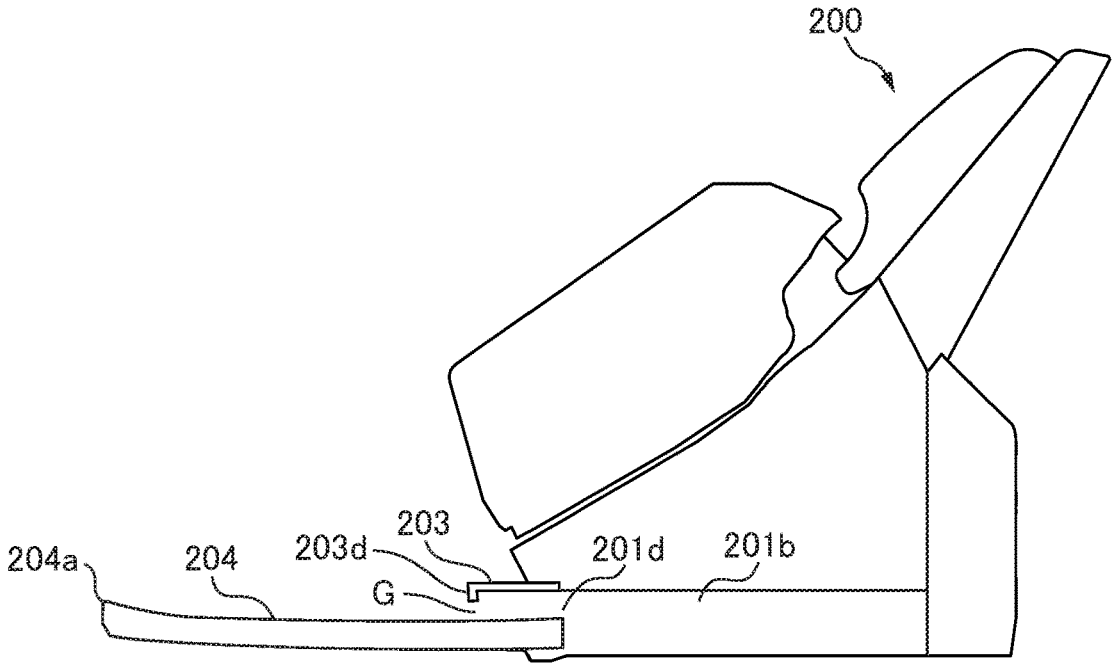
FIG. 8B is a schematic view for explaining the paper ejection apparatus including the cover fixed in position.

FIGS. 8A and 8B are schematic views for explaining a paper ejection apparatus 200 including a cover 203 fixed in position. FIG. 8A illustrates the paper ejection apparatus 200 not in use, and FIG. 8B illustrates the paper ejection apparatus 200 in use.

To appropriately stack the ejected paper on a tray 204, a downstream leading end 204*a* of the tray 204 may be preferably located high. As illustrated in FIG. 8A, to cover an opening 201*d* in a storage space 201*b* when the tray 204 is stored, a downstream leading end 203*d* of the cover 203 may preferably abut against the leading end 204*a* of the tray 204 and the leading end 203*d* may be preferably located high. For this reason, as illustrated in FIG. 8B, when the cover 203 is fixed in position, a gap G occurs between the leading end 203*d* of the cover 203 and the tray 204 upon pullout from the tray 204, so the opening 201*d* may not be covered. Therefore, in the paper ejection apparatus 200, the paper ejected onto the tray 204 may enter the storage space 201*b*. In addition, in the paper ejection apparatus 200, a step may occur between the cover 203 and the tray 204 due to the presence of the gap G, so the paper may not be smoothly ejected onto the tray 204.

Figure 9A:
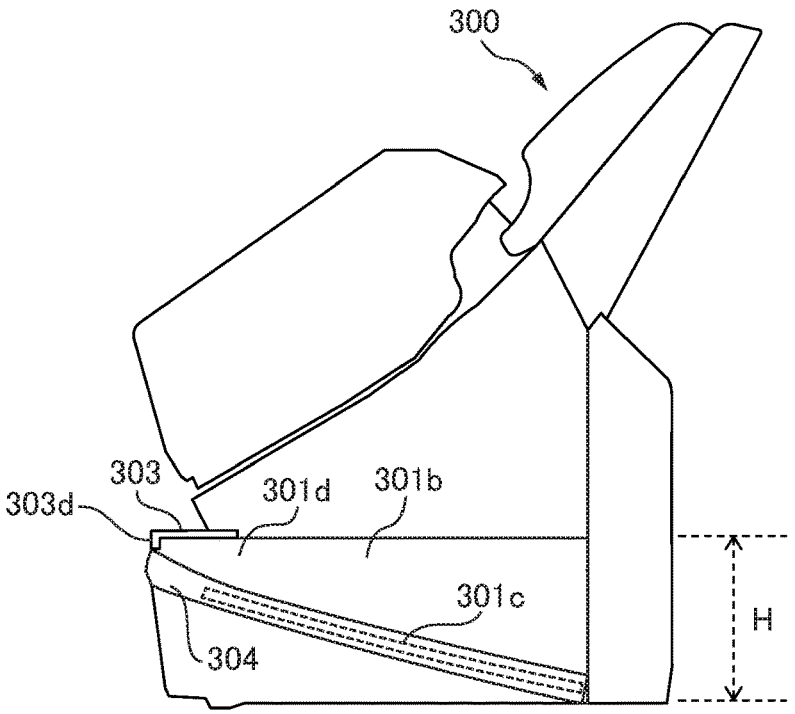
FIG. 9A is a schematic view for explaining another paper ejection apparatus including a cover fixed in position.
Figure 9B:
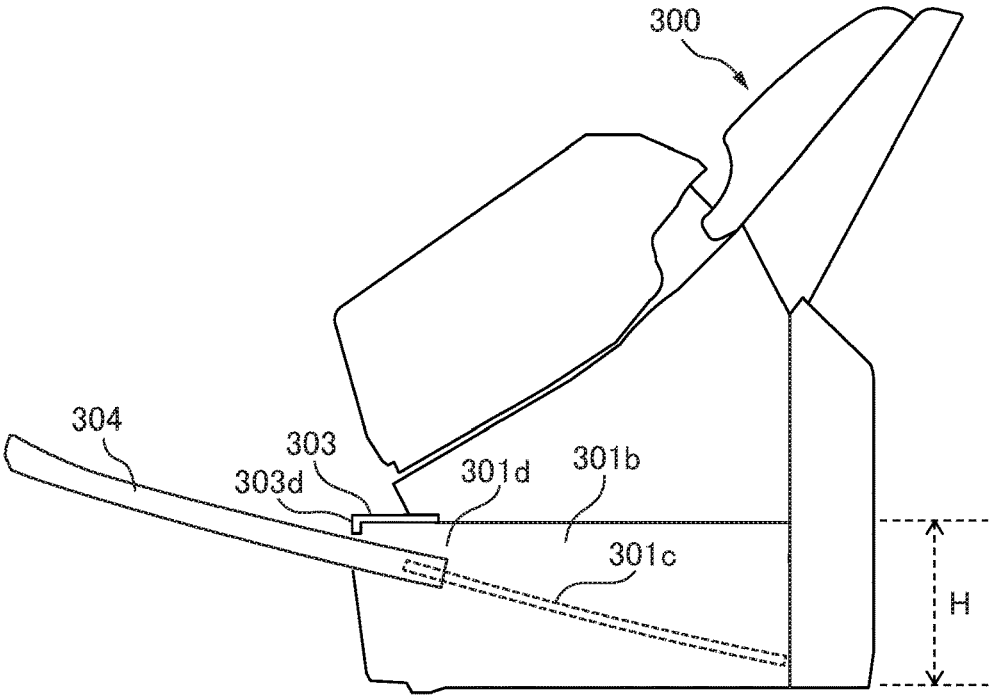
FIG. 9B is a schematic view for explaining the other paper ejection apparatus including the cover fixed in position.

FIGS. 9A and 9B are schematic views for explaining another paper ejection apparatus 300 including a cover 303 fixed in position. FIG. 9A illustrates the paper ejection apparatus 300 not in use, and FIG. 9B illustrates the paper ejection apparatus 300 in use.

As illustrated in FIG. 9A, in the paper ejection apparatus 300, storage rails 301*c* are tilted with respect to the installation surface of the paper ejection apparatus 300 in a storage space 301*b* of a tray 304. With this arrangement, as illustrated in FIG. 9B, even when the cover 303 is fixed in position, no gap occurs between a downstream leading end 303*d* of the cover 303 and the tray 304 upon pullout from the tray 304, so that an opening 301*d* of the storage space 301*b* can be covered. However, in the paper ejection apparatus 300, the height H of the storage space 301*b* is high and the height of the entire paper ejection apparatus 300 is, in turn, high. In this case, the position of a paper support on which paper to be fed are set may also be high, thus making it hard for the user to set paper.

The paper ejection apparatus 300 can prevent the occurrence of a gap between the leading end 303*d* of the cover 303 and the tray 304 upon pullout from the tray 304 even by setting the curvature of the tray 304 large, instead of tilting the storage rails 301*c*. However, even when the curvature of the tray 304 is set large, the height H of the storage space 301*b* is high and the height of the entire paper ejection apparatus 300 is, in turn, high.

The paper ejection apparatus 100 according to this embodiment moves the swinging end 103*d* of the cover 103 downwards in response to an operation for pulling out the tray 104. With this operation, the paper ejection apparatus 100 can always cover the gap between the storage space 101*b* and the tray 104 using the cover 103 while providing the storage rails 101*c* substantially horizontally with respect to the installation surface of the device by locating the downstream end 104*a* of the tray 104 high. Therefore, the paper ejection apparatus 100 can prevent the paper ejected onto the tray 104 from entering the gap between the storage space 101*b* and the tray 104 while appropriately stacking the ejected paper on the tray 104 and keeping the height of the entire paper ejection apparatus 100 lower. In the paper ejection apparatus 100, since the swinging end 103*d* of the cover 103 always abuts against the tray 104, no step occurs between the cover 103 and the tray 104 so that the paper can be smoothly ejected onto the tray 104. In the paper ejection apparatus 100, since the height of the entire paper ejection apparatus 100 is kept lower, the working space of the user can also be kept small. Furthermore, in the paper ejection apparatus 100, since the height of the paper support 102 is also kept lower, the user's convenience in setting paper can be improved.

As described in detail above, in a paper ejection apparatus 100 including a tray 104 provided so as to be stored in the storage space 101*b* of the housing 101, the ejected paper is prevented from entering the gap between the storage space 101*b* and the tray 104.

In the paper ejection apparatus 100, the tray 104 is provided so as to be stored in the storage space 101*b*, instead of being foldably provided on the front surface of the paper ejection apparatus 100. Therefore, when a display such as an LCD (Liquid Crystal Display) is provided on the front surface of the paper ejection apparatus 100, the user can use the display with the tray 104 stored in the storage space 101*b*. Therefore, the user can use the paper ejection apparatus 100 even at a position having no space sufficient to pull out the tray 104.

In the paper ejection apparatus 100, since the storage space 101*b* is covered by the cover 103 and may not be visually observed by the user, the design performance can be improved.

Figure 10A:
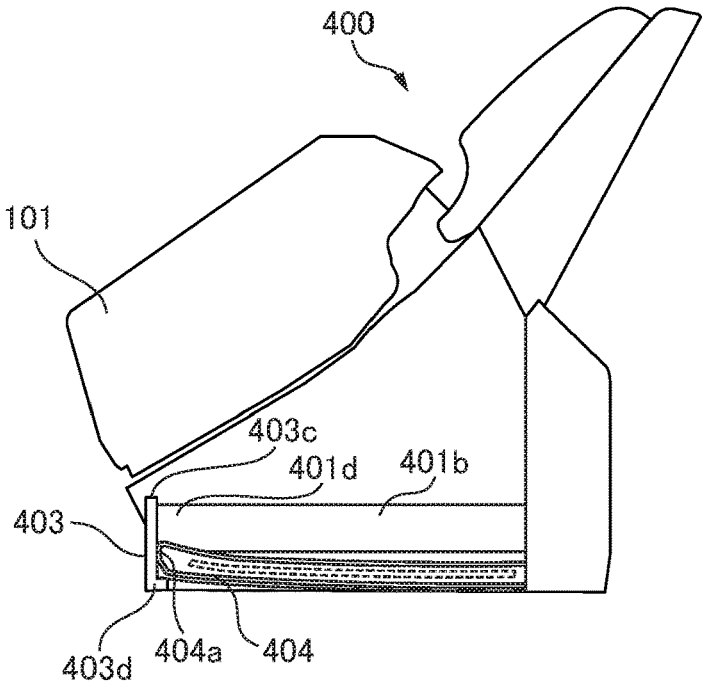
FIG. 10A is a schematic view for explaining a paper ejection apparatus 400 according to another embodiment.
Figure 10B:
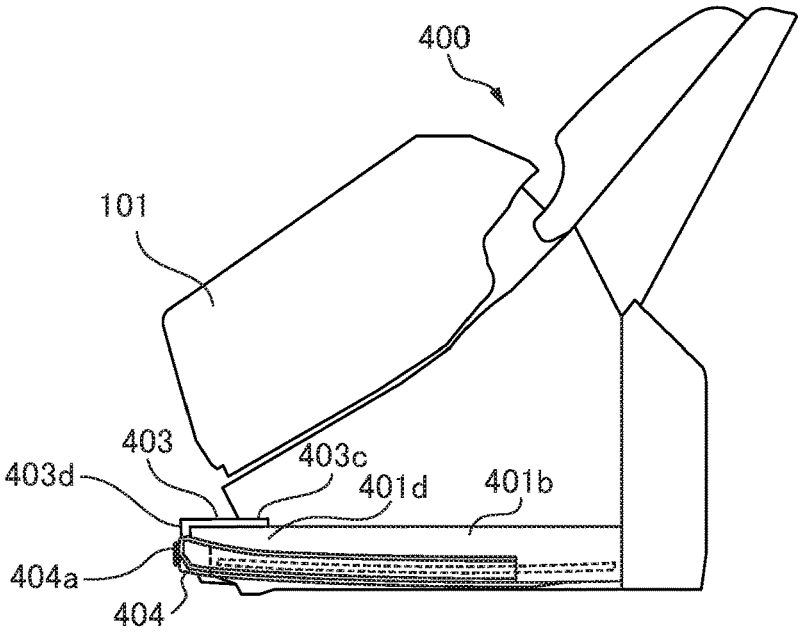
FIG. 10B is a schematic view for explaining the paper ejection apparatus 400 according to the other embodiment.

FIGS. 10A and 10B are schematic views for explaining a paper ejection apparatus 400 according to another embodiment. FIG. 10A illustrates the paper ejection apparatus 400 not in use, and FIG. 10B illustrates the paper ejection apparatus 400 in the process of pulling out a tray 404.

As illustrated in FIG. 10A, in the paper ejection apparatus 400, the angle that a cover 403 makes with the installation surface of the paper ejection apparatus 400 with the tray 404 stored in a storage space 401*b* is substantially 90° (88° to 92°). In the paper ejection apparatus 400, in this state, an opening 401*d* in the storage space 401*b* is covered only by the cover 403. In this state, when the tray 404 is pulled out, the tray 404 moves with its downstream leading end 404*a* in a paper ejection direction A1 abutting against the cover 403. Then, a swinging end 403*d* of the cover 403 swings about a swinging shaft 403*c* and moves upwards by working with an operation for pulling the tray 404 out from the storage space 401*b*. As illustrated in FIG. 10B, when the swinging end 403*d* of the cover 403 abuts against the leading end 404*a* of the tray 404, the swinging end 403*d* of the cover 403 is located highest. In this state, when the tray 404 is further pulled out, the swinging end 403*d* of the cover 403 swings about the swinging shaft 403*c* and moves downwards by working with an operation for pulling the tray 404 out from the storage space 401*b*, similarly to the paper ejection apparatus 100 illustrated in FIG. 7B.

As described in detail above, even in the paper ejection apparatus 400, the ejected paper is prevented from entering the gap between the storage space 401*b* and the tray 404.

While preferred embodiments have been described above, it is not limited thereto. The paper ejection apparatus 100 may be designed not as an image scanner but as, e.g., a fax machine, an inkjet printer, a laser printer, or a printer multifunctional device, i.e., an MFP (Multifunction Peripheral).

According to the embodiments, in a paper ejection apparatus including a tray provided so as to be stored in a storage space of a housing, ejected paper is prevented from entering the gap between the storage space and the tray.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper ejection apparatus comprising:

a housing including an ejection slot for ejecting a paper and a storage space provided below the ejection slot;

a tray, formed in a downward arcuate shape and stored in the storage space to be pullable out from the storage space, for stacking the paper ejected from the ejection slot when the tray is pulled out from the storage space; and a cover swingably provided on the housing between the ejection slot and an opening of the storage space; wherein a swinging axis of the cover is provided above the opening, the cover is configured to move with a swinging end abutting against an upper surface of the tray and covers the opening when the tray is pulled out from the storage space, and the swinging end of the cover is configured to move downwards by working with an operation for pulling the tray out from the storage space.

2. The paper ejection apparatus according to claim 1, wherein the opening is covered by an end of the tray and the cover as the tray is stored in the storage space.

3. The paper ejection apparatus according to claim 1, wherein the tray includes a rib for extending in a paper ejection direction, and the cover includes a protrusion, provided at the swinging end, for abutting against the rib when the tray is pulled out from the storage space.

4. The paper ejection apparatus according to claim 1, wherein the tray is formed such that a curvature at a downstream end of the tray is larger than a curvature at an upstream end of the tray in a paper ejection direction, and wherein the tray is provided such that the downstream end of the tray in the paper ejection direction projects from the opening when the tray is stored in the storage space.

5. The paper ejection apparatus according to claim 1, wherein the tray is provided such that a downstream end of the tray is located upstream of a downstream end of the housing in the paper ejection direction when the tray is stored in the storage space.

* * * * *